US011713630B2

(12) United States Patent
Olander

(10) Patent No.: US 11,713,630 B2
(45) Date of Patent: Aug. 1, 2023

(54) DIRECTIONAL DRILL VICE AND METHOD

(71) Applicant: TT Technologies, Inc., Aurora, IL (US)

(72) Inventor: John A. Olander, Aurora, IL (US)

(73) Assignee: TT Technologies, Inc., Aurora, IL (US)

( * ) Notice: Subject to any disclaimer, the term of this patent is extended or adjusted under 35 U.S.C. 154(b) by 0 days.

(21) Appl. No.: 17/209,775

(22) Filed: Mar. 23, 2021

(65) Prior Publication Data

US 2021/0207444 A1 Jul. 8, 2021

Related U.S. Application Data

(63) Continuation of application No. 16/985,360, filed on Aug. 5, 2020, now Pat. No. 10,975,636, which is a continuation of application No. 15/879,987, filed on Jan. 25, 2018, now Pat. No. 10,760,358.

(60) Provisional application No. 62/501,412, filed on May 4, 2017.

(51) Int. Cl.

| | |
|---|---|
| ***E21B 19/16*** | (2006.01) |
| ***E21B 17/046*** | (2006.01) |
| ***E21B 7/04*** | (2006.01) |
| ***E21B 17/042*** | (2006.01) |
| ***E21B 19/15*** | (2006.01) |
| ***E21B 15/04*** | (2006.01) |
| ***E21B 19/24*** | (2006.01) |
| ***E21B 19/14*** | (2006.01) |
| ***E21B 7/02*** | (2006.01) |

(52) U.S. Cl.

CPC ..... *E21B 19/16* (2013.01); *E21B 7/02* (2013.01); *E21B 7/04* (2013.01); *E21B 15/045* (2013.01); *E21B 17/042* (2013.01); *E21B 17/046* (2013.01); *E21B 19/14* (2013.01); *E21B 19/155* (2013.01); *E21B 19/161* (2013.01); *E21B 19/24* (2013.01)

(58) Field of Classification Search

CPC ..... E21B 19/16; E21B 19/161

See application file for complete search history.

(56) References Cited

U.S. PATENT DOCUMENTS

| | | | | |
|---|---|---|---|---|
| 10,760,358 | B2 | 9/2020 | Olander et al. | |
| 2003/0205411 | A1 | 11/2003 | Pierce | |
| 2010/0307827 | A1* | 12/2010 | Piipponen | E21B 19/14 405/259.1 |
| 2014/0151124 | A1* | 6/2014 | Randall | E21B 19/16 175/62 |
| 2015/0259993 | A1 | 9/2015 | Patel et al. | |
| 2018/0320457 | A1 | 11/2018 | Olander | |
| 2020/0378188 | A1 | 12/2020 | Olander | |

OTHER PUBLICATIONS

"U.S. Appl. No. 15/879,987, Advisory Action dated Feb. 13, 2020", 3 pgs.

(Continued)

*Primary Examiner* — Kristyn A Hall

(74) *Attorney, Agent, or Firm* — Schwegman Lundberg & Woessner, P.A.

(57) ABSTRACT

A directional drill vice and associated methods are shown. A directional drill and associated methods are also shown. Examples of directional drill stem configurations include gripping jaws configured with a common jaw pivot. Examples of directional drill stem configurations also include a slot in a vice frame to allow lateral insertion of a drill stem segment.

11 Claims, 4 Drawing Sheets

(56) References Cited

OTHER PUBLICATIONS

"U.S. Appl. No. 15/879,987, Advisory Action dated Mar. 30, 2020", 3 pgs.
"U.S. Appl. No. 15/879,987, Final Office Action dated Nov. 18, 2019", 6 pgs.
"U.S. Appl. No. 15/879,987, Non Final Office Action dated Jun. 26, 2019", 11 pgs.
"U.S. Appl. No. 15/879,987, Notice of Allowance dated May 4, 2020", 5 pgs.
"U.S. Appl. No. 15/879,987, Response filed Jan. 21, 2020 to Final Office Action dated Nov. 18, 2019", 7 pgs.
"U.S. Appl. No. 15/879,987, Response filed Feb. 18, 2020 to Advisory Action dated Feb. 13, 2020", 7 pgs.
"U.S. Appl. No. 15/879,987, Response filed Apr. 16, 2020 to Advisory Action dated Mar. 30, 2020", 7 pgs.
"U.S. Appl. No. 15/879,987, Response filed Sep. 26, 2019 to Non-Final Office Action dated Jun. 26, 2019", 7 pgs.
"U.S. Appl. No. 16/985,360, Non Final Office Action dated Sep. 18, 2020", 6 pgs.
"U.S. Appl. No. 16/985,360, Notice of Allowance dated Dec. 24, 2020", 7 pgs.
"U.S. Appl. No. 16/985,360, Response filed Dec. 9, 2020 to Non Final Office Action dated Sep. 18, 2020", 8 pgs.

* cited by examiner

DIRECTIONAL DRILL VICE AND METHOD

CLAIM FOR PRIORITY

This application is a continuation of U.S. patent Ser. No. 16/985,360, filed Aug. 5, 2020, which is continuation of U.S. patent Ser. No. 15/879,987, filed Jan. 25, 2018, which claims the benefit of priority of U.S. Provisional Application 62/501,412, filed May 4, 2017, all of which are hereby incorporated by reference in their entirety.

TECHNICAL FIELD

Embodiments described herein generally relate to directional drilling. Specific examples may include drill stem vices for adding or removing segments from a drill string.

BACKGROUND

Directional drills are used for a number of types of jobs. A bore is made in the ground by piercing with a drill stem. In one use, new pipe may be drawn back through the bore that was formed. In this way, new pipe may be installed without the need to dig a trench in the ground first. For example, a utility line may be installed beneath a roadway without the need to close the road during the installation process. Progress of a directional drill stem may be monitored, and the tip of a drill stem may be steered to direct the bore over long distances. As a bore progresses, commonly, drill stem segments are added to increase a length of the drill stem until the bore reaches its intended destination. After the bore is complete, the drill stem may be retracted from the bore, and drill stem segments may be removed as the drill stem is retracted.

It is desirable to have a reliable system to add and remove segments of drill stem. It is further desirable to reduce cost of the directional drill.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
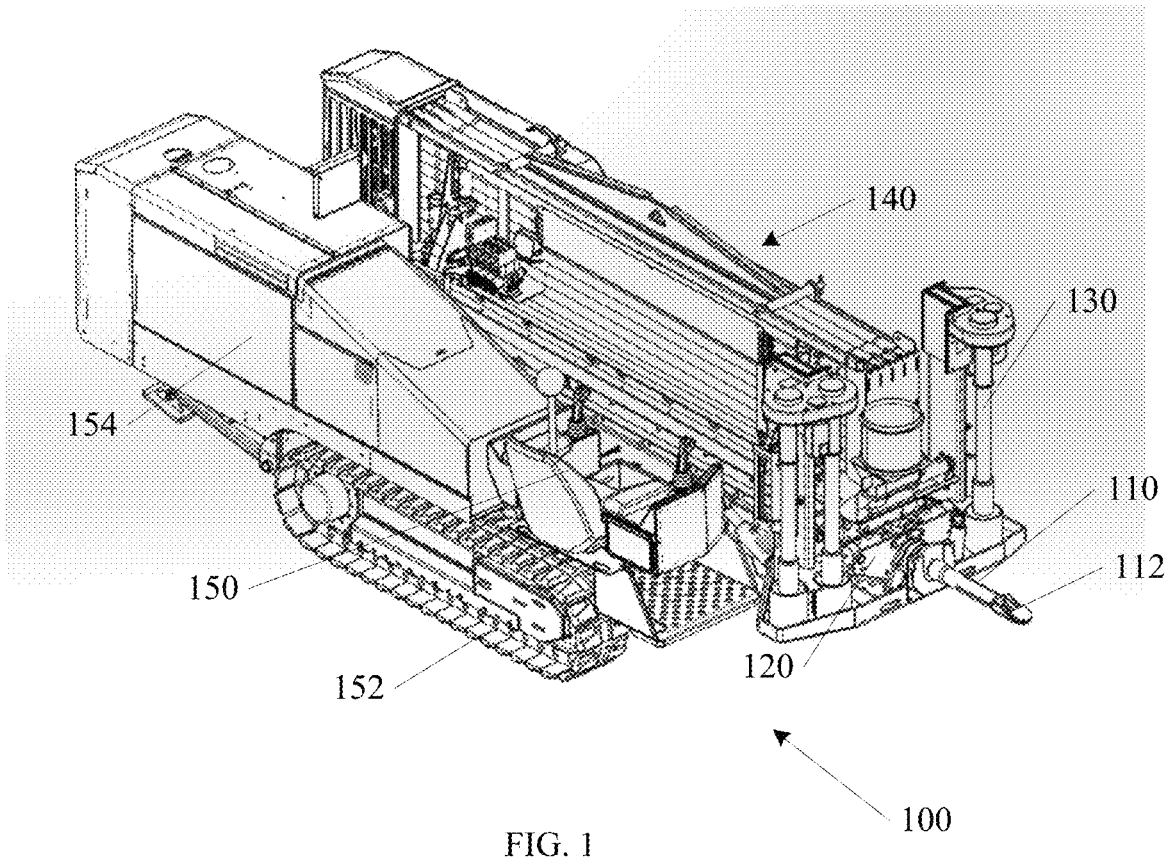
FIG. 1 is a directional drill in accordance with some embodiments of the invention.

FIG. 1 shows an example of a directional drill 100. The directional drill 100 includes a drill stem 110 including an attached sonde housing, and a drill head 112 for piercing the ground and leading a directional drill bore operation. A drill stem loader 140 is shown coupled to the directional drill 100. The drill stem loader 140 is configured to pick drill stem segments (or drill rods) from a drill stem magazine and add stem segments to the stem 110 during a boring operation. The drill stem loader 140 is further configured to remove stem segments from the drill stem 110 and replace them in the drill stem magazine after the boring operation is complete, and the drill stem is being retracted from the bore.

A power supply 154 is coupled to the directional drill 100 to drive the drill stem 110, and to operate other aspects of the directional drill 100. A cockpit 150 is further included in the directional drill 100, the cockpit 150 including a number of controllers and gauges to control and monitor a drilling operation. In on example, a track system 152 is included on the directional drill 100 to move and position the directional drill 100. A stake down system 130 is also shown coupled to a front end of the directional drill 100 in the example of FIG. 1. A directional drill vice 120 is further shown at a front end of the directional drill 100. Additional aspects of the directional drill vice 120 are described in more detail below.

Figure 2:
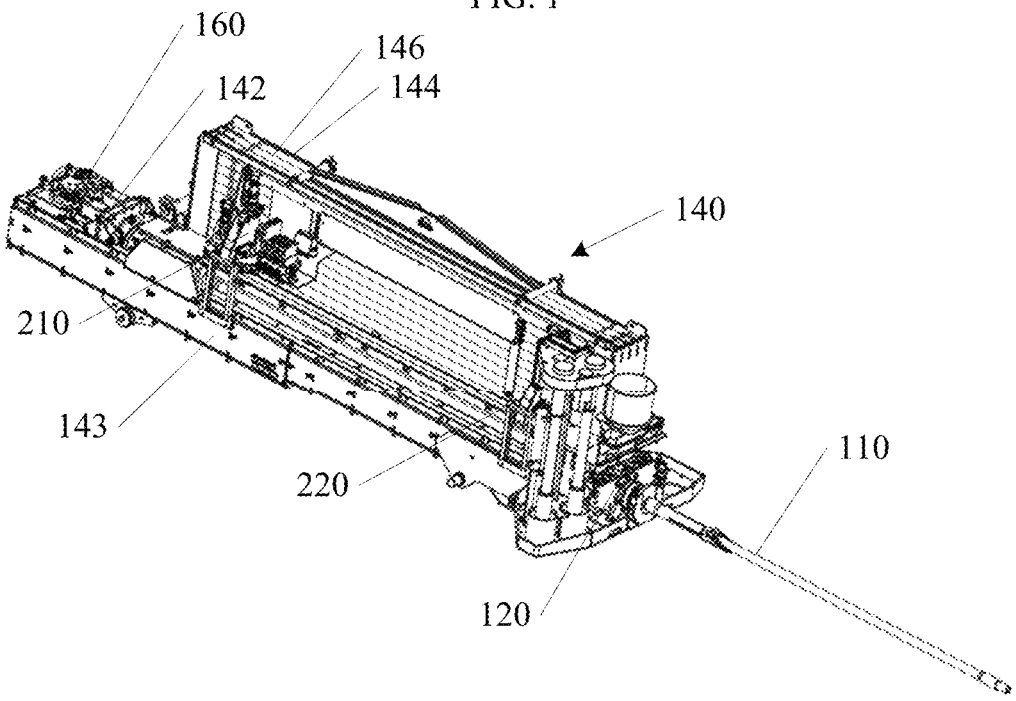
FIG. 2 is a portion of a directional drill in accordance with some embodiments of the invention.

FIG. 2 shows a portion of a directional drill 100 from FIG. 1, with a number of components removed to reveal more detail of a directional drill stem loader 140 according to an embodiment of the invention. The drill stem loader 140 includes a drill stem magazine 144, having a number of individual drill stem segments 146 loaded into the magazine 144.

A first linear actuator 210 and a second linear actuator 220 are shown adjacent to the drill stem magazine 144. In one example, the linear actuators 210, 220 are coupled to a pair of drill stem grippers. Although two linear actuators are shown, the invention is not so limited. Other configurations may include a single linear actuator, or more than two linear actuators. In one example, the directional drill vice 120 includes a slot that coordinates with the first linear actuator 210 and a second linear actuator 220 to load a drill stem segment laterally into the directional drill vice 120.

A drill head 142 is shown at a rear of the drill stem loader 140. The drill head 142 is mounted to a carriage frame 143 along a movable track. In one example, a drill fluid supply system 160 is coupled to the directional drill 100, adjacent to the drill head 142. During a drilling operation, the drill head 142 is operated to both rotate the drill stem 110, and to drive the drill stem 110 forward into the ground. The drill stem vice 120 is shown at a front end of the drill stem loader 140. During a drilling operation, the directional drill vice 120 selectively holds or releases individual segments of the drill stem 110 to aid in the adding or removal of drill stem segments (by screwing or unscrewing a threaded joint at either end of the drill stem segment).

Figure 3:
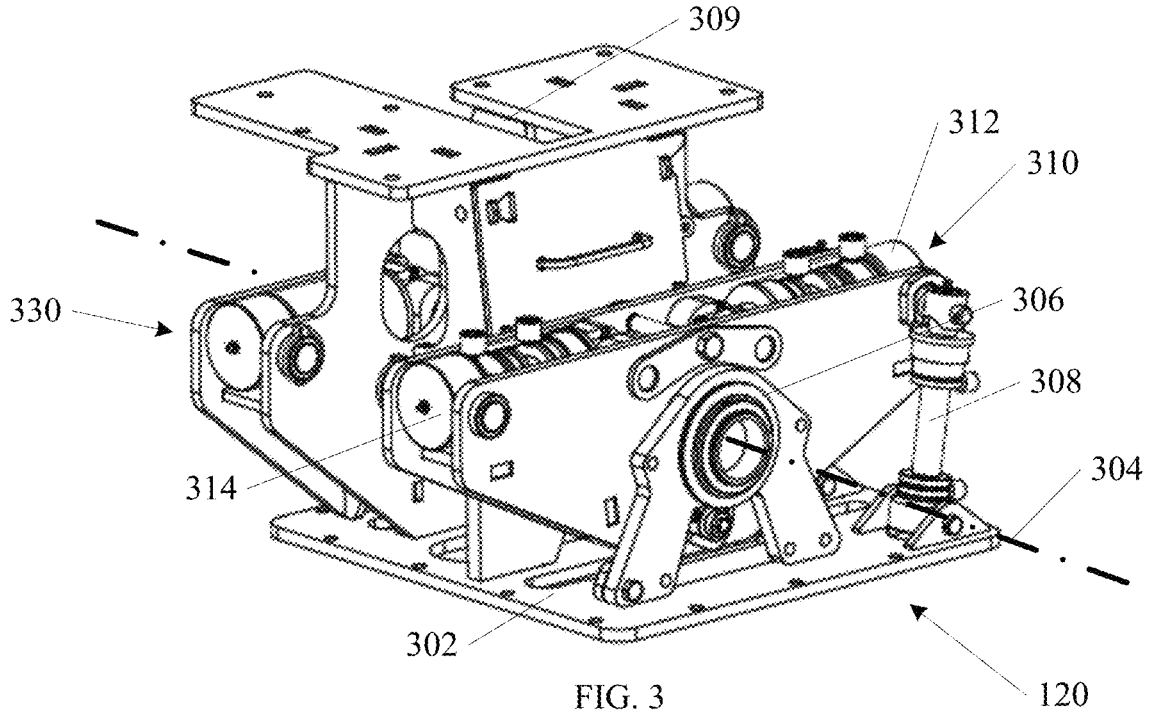
FIG. 3 is a front view of a directional drill vice in accordance with some embodiments of the invention.

FIG. 3 shows a front view of an example drill stem vice 120. The drill stem vice 120 includes a base 302. A first gripping device 310 and a second gripping device 330 are shown coupled to the base 302. The first gripping device 310 is shown with a first pair of actuators 312, 314. In operation, each of the first pair of actuators 312, 314 forces a respective gripping jaw into engagement with a surface of a drill stem segment, or removes the respective gripping jaws from contact with the drill stem segment. This operation will be shown in more detail in subsequent figures.

Figure 4:
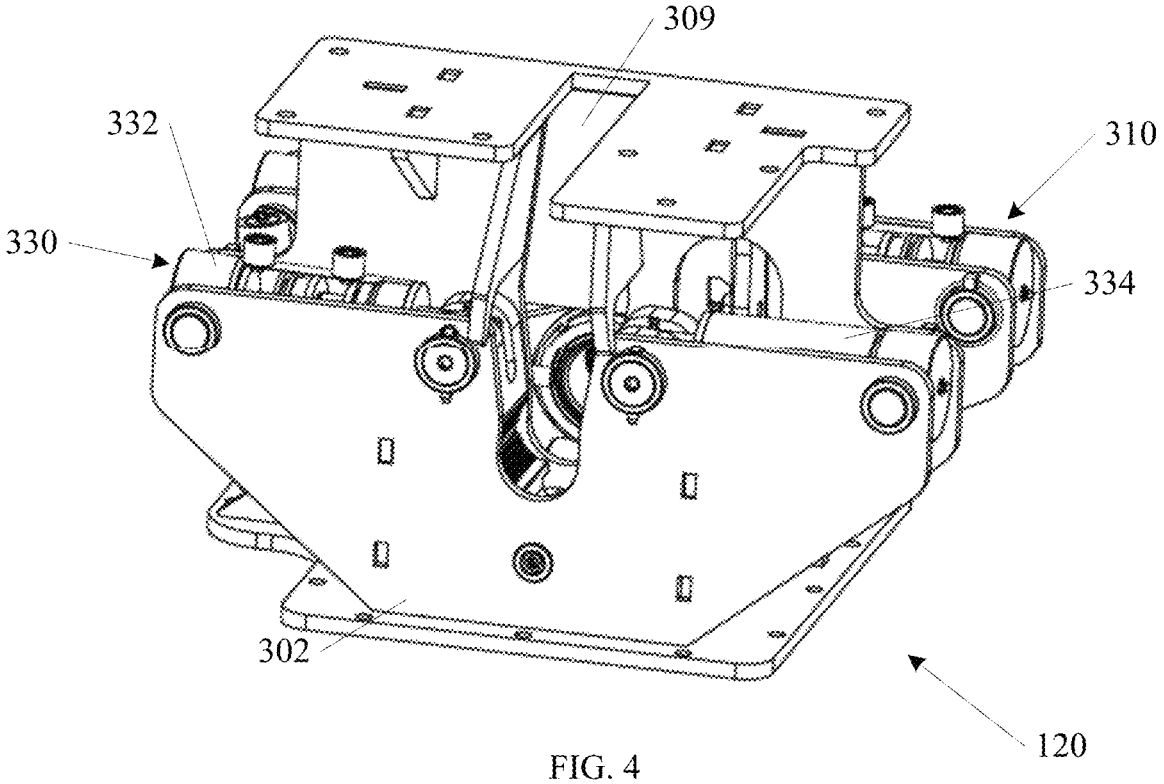
FIG. 4 is a rear view of a directional drill vice in accordance with some embodiments of the invention.

FIG. 4 shows a rear view of the drill stem vice 120. In this view, the second gripping device 330 is shown to include a second pair of actuators 332, 334. Similar to the first gripping device 310, in operation, each of the second pair of actuators 332, 334 forces a respective gripping jaw into engagement with a surface of a drill stem segment, or removes the respective gripping jaws from contact with the drill stem segment.

Although pairs of actuators are shown associated with both the first gripping device 310 and the second gripping device 330, the invention is not so limited. In other examples, a single actuator may operate the first gripping device 310, and a single actuator may operate the second gripping device 330. In the example shown, the actuators are hydraulic cylinders, however the invention is not so limited. In other examples, other types of actuators, such as solenoids, stepper motors, etc. may be used.

In one example, the second gripping device 330 is rigidly fixed to the base 302, while the first gripping device 310 is mounted to the base 302 through a rotation joint 306. As shown, the rotation joint 306 has an axis of rotation that is concentric with a drill string axis 304. A rotation actuator 308 is shown coupled between the base 302 and the first gripping device 310 to provide controlled rotation about the rotation joint 306.

In a drill stem removal operation, a drill string, composed of multiple drill stem segments, may be located within both the first gripping device 310 and the second gripping device 330 along drill string axis 304. A connection interface between two adjacent drill stem segments may be aligned between the first gripping device 310 and the second gripping device 330. The rigidly connected second gripping device 330 may then hold one drill stem segment in place, while the entire first gripping device 310 is rotated about the rotation joint 306, while gripping the adjacent drill stem segment. This rotation of the first gripping device 310 and the adjacent drill stem segment may loosen, or "break" loose a threaded joint between the adjacent drill stem segments. Once the threaded joint is loosened, the drill head 142 from FIGS. 1 and 2 may complete the unscrewing process of the drill stem segment and replace the removed drill stem segment into the drill stem magazine 144.

In a drill stem extension operation, the first gripping device 310 may grip an end of the drill stem, while the drill head 142 from FIGS. 1 and 2, fetches a new drill stem segment for installation into the drill string. The drill head 142 may screw the new drill stem segment into the drill string while the first gripping device 310 holds the drill stem secure. Once the new drill stem segment is installed, the first gripping device 310 may be released, and the drill stem may be extended in a normal drilling operation until the next new drill stem segment is needed.

The example drill stem vice 120 shown in FIGS. 3 and 4 further includes a slot 309 to permit sideways loading and unloading of drill stem segments into and out of the drill stem vice 120. FIGS. 3 and 4 show the slot 309 extending adjacent to only the second gripping device 330. In one example, drill stem segments are only loaded or unloaded from the second gripping device 330, and sideways access to the first gripping device 310 is not needed. In the examples shown, the slot 309 is oriented upward to permit vertical loading into the drill stem vice 120, however the invention is not so limited. Other orientations of the slot 309, such as sideways, left, right, downward, or at other angles are also within the scope of the invention.

Using the vertical orientation of the slot 309 shown in FIGS. 3 and 4, and the drill stem magazine 144 being located substantially over a center of the directional drill 100, the directional drill 100 becomes more stable. Weight from the drill stem magazine 144 and the drill stem segments is more centered over the directional drill 100. Further, using the vertically oriented slot 309 and drill stem magazine 144 configuration shown, a more simple mechanism may be used to load and unload drill stem segments. In one example, drill stem segments may be loaded and unloaded in a linear range of motion, which reduces complexity of loading an unloading mechanisms, when compared to multiple translations and multiple directions of movement required in other existing directional drill configurations.

In one example a new drill stem segment may be directly loaded sideways into the second gripping device 330 of the drill stem vice 120. The second gripping device 330 may then clamp onto the new drill stem segment and hold it secure while the drill head 142 screws into the new drill stem segment. In other configurations without a slot 309, a new drill stem segment cannot be gripped immediately after being placed in line with the drill stem axis 304. In such configurations, a transfer system such as the first linear actuator 210 and the second linear actuator 220, must be made more robust, to hold the new drill stem segment while the drill head 142 screws into the new drill stem segment. Configurations with a slot 309 allow the complexity of the transfer system such as the first linear actuator 210 and the second linear actuator 220 to be reduced, thus reducing cost and improving reliability of the directional drill 100.

Figure 5:
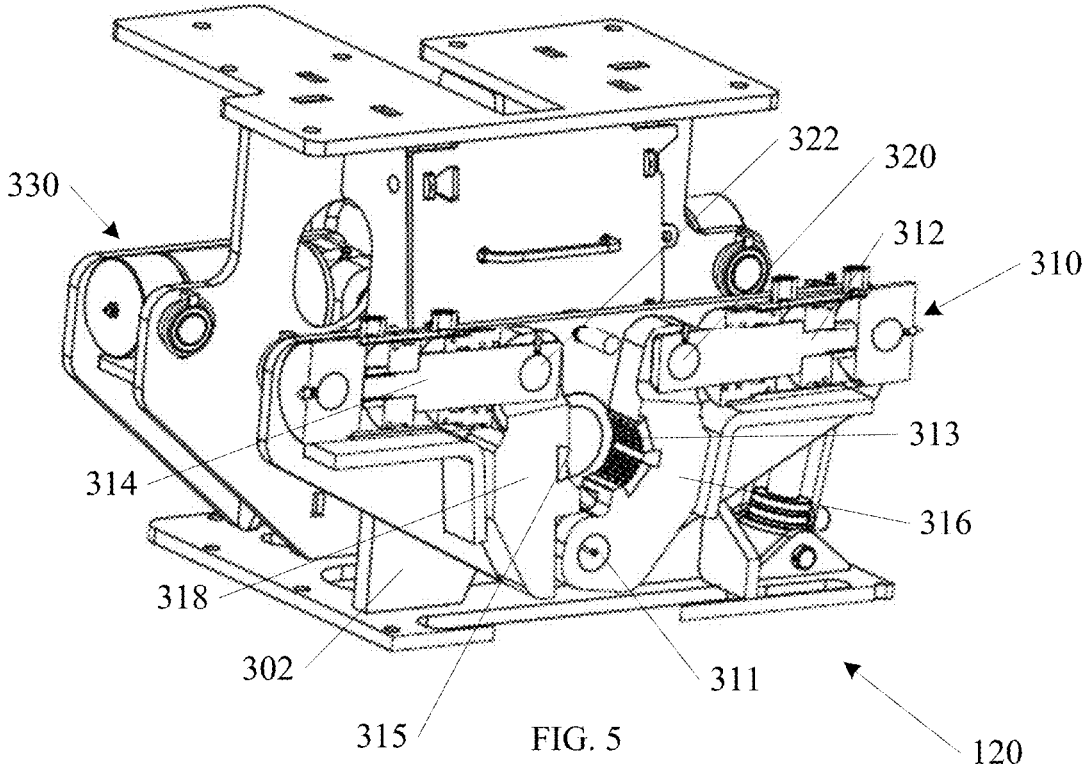
FIG. 5 shows a cross sectional view of a directional drill vice in accordance with some embodiments of the invention.

FIG. 5 shows a cross section of the first gripping device 310 of the drill stem vice 120 according to one example. In the example of FIG. 5, a first jaw carrier 316 and a second jaw carrier 318 are shown. A pair of gripping jaws is shown in place within the first jaw carrier 316 and the second jaw carrier 318. A first jaw 313 is shown housed within the first jaw carrier 316, and a second jaw 315 is shown housed within the second jaw carrier 318. In selected examples, having separate jaws 313, 315 housed within jaw carriers 316, 318 provides an advantage of replace ability. If one or both of the jaws 313, 315 becomes unduly worn, it may be removed from within the jaw carrier 316, 318 and replaced with minimal effort. Although replaceable jaws are shown in this example, the invention is not so limited. Other examples may include jaws that are integral with vice components.

FIG. 5 further shows a common jaw pivot 311. As the name implies, the common jaw pivot 311 is common to both the first jaw carrier 316 and the second jaw carrier 318. One advantage of a common jaw pivot 311 includes ease and accuracy of maintaining a drill string segment in concentric relation along the drill stem axis 304 when a gripping device (first gripping device 310 and/or second gripping device 330) is actuated and holding one or more drill stem segments. In contrast to configurations with independent jaw actuation, it is easier to accurately control jaw location when both jaws are constrained by a common pivot point. Additionally, it is possible to cheaply manufacture a high tolerance single pivot point, compared to the manufacturing cost required to accurately move two separate mechanisms. Further it is easier and cheaper to make a high tolerance pivot point compared to a high tolerance slide joint. Another advantage includes the ability to easily keep the common jaw pivot 311 free of unwanted debris, compared to other configurations such as more complex linkages or slide configurations.

FIG. 5 further shows the first actuator 312 coupled to the first jaw carrier 316 at a pivot 320. Likewise, the second actuator 314 is coupled to the second jaw carrier 318 at a pivot 322. The arrangement shown in FIG. 5, including the common jaw pivot 311, pivots 320 and 322, allows for design requirements that may reduce the size of the first actuator 312 and the second actuator 314. The mechanical advantage of the pivot arrangement 311, 320, 322 provides the necessary force needed for gripping a drill stem segment without the need for larger actuators.

Although FIG. 5 only shows a cross section of the first gripping device 310, in one example, the second gripping device 330 is similarly configured. The accuracy and reduced cost provided by both the first gripping device 310 and the second gripping device 330 is accentuated when two drill stem segments are both gripped at the same time, and both drill stem segments are more accurately located along the drill stem axis 304.

Figure 6:
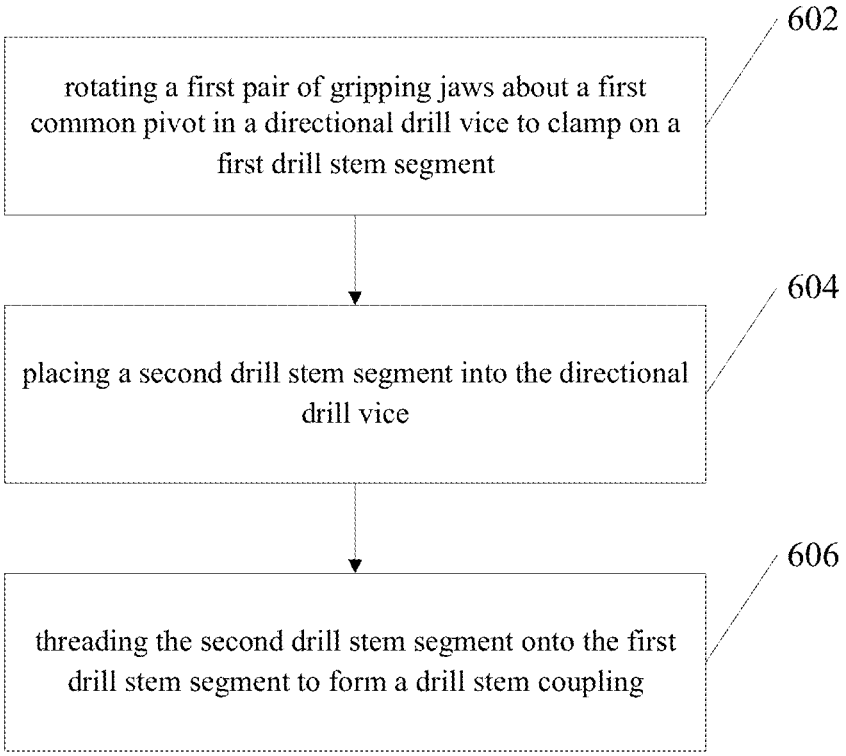
FIG. 6 is a flow diagram of a method of operating a directional drill vice in accordance with some embodiments of the invention.

FIG. 6 shows a flow diagram of a method of directional drilling according to one example of the invention. In operation 602, a first pair of gripping jaws is rotated about a first common pivot in a directional drill vice to clamp on a first drill stem segment. In operation 604, a second drill stem segment is placed into the directional drill vice, and in operation 606, the second drill stem segment is threaded onto the first drill stem segment to form a drill stem coupling.

To better illustrate the method and apparatuses disclosed herein, a non-limiting list of examples is provided here:

Example 1 includes a directional drill vice. The vice includes a first pair of gripping jaws located in a vice frame, at least one actuating device coupled to the first pair of gripping jaws, and a common jaw pivot coupled to both jaws in the first pair of gripping jaws, the common pivot coupled to the vice frame; wherein both jaws in the first pair of gripping jaws are constrained to only rotational motion about the common jaw pivot.

Example 2 includes the directional drill vice of example 1, wherein the first pair of gripping jaws includes replaceable jaws held in jaw carriers.

Example 3 includes the directional drill vice of any one of examples 1-2, wherein each jaw in the first pair of gripping jaws is actuated by a separate actuating device.

Example 4 includes the directional drill vice of any one of examples 1-3, wherein each jaw carrier includes the common pivot on a first end of the jaw carrier and an actuating device coupled to a second end of the jaw carrier.

Example 5 includes the directional drill vice of any one of examples 1-4, further including a second pair of gripping jaws.

Example 6 includes the directional drill vice of any one of examples 1-5, further including a rotation joint between the first pair of gripping jaws and the second pair of gripping jaws to provide rotation about a drill stem axis, and a rotation actuator to drive relative rotation between the first pair of gripping jaws and the second pair of gripping jaws.

Example 7 includes a directional drill. The directional drill includes a first gripper, including a first pair of gripping jaws located in a vice frame, at least one actuating device coupled to the first pair of gripping jaws, and a first common jaw pivot coupled to both jaws in the first pair of gripping jaws, the first common pivot coupled to the vice frame; wherein both jaws in the first pair of gripping j aws are constrained to only rotational motion about the first common jaw pivot.

The directional drill includes a second gripper, including a second pair of gripping jaws located in a vice frame, at least one actuating device coupled to the second pair of gripping jaws, and a second common jaw pivot coupled to both jaws in the second pair of gripping jaws, the second common pivot coupled to the vice frame; wherein both jaws in the second pair of gripping jaws are constrained to only rotational motion about the second common jaw pivot.

The directional drill includes a slot in the vice frame to allow lateral insertion of a drill stem segment into the first gripper, a rotation joint between the first gripper and the second gripper to provide rotation about a drill stem axis, and a rotation actuator to drive relative rotation between the first gripper and the second gripper.

Example 8 includes the directional drill of example 7, wherein the actuating devices are hydraulic actuating devices.

Example 9 includes the directional drill of any one of examples 7-8, wherein the rotation actuator is a hydraulic rotation actuator.

Example 10 includes the directional drill of any one of examples 7-9, wherein the first gripper is fixed with respect to the vice frame, and the second gripper rotates relative to the vice frame about the rotation joint.

Example 11 includes a method of directional drilling. The method includes rotating a first pair of gripping jaws about a first common pivot in a directional drill vice to clamp on a first drill stem segment, placing a second drill stem segment into the directional drill vice, and threading the second drill stem segment onto the first drill stem segment to form a drill stem coupling.

Example 12 includes the method of example 11, wherein placing the second drill stem segment into the directional drill vice includes laterally inserting the second drill stem through a slot in the directional drill vice.

Example 13 includes the method of any one of examples 11-12, wherein rotating a first pair of gripping jaws about a first common pivot includes actuating the first pair of gripping jaws using two actuators with one actuator for each jaw in the first pair of gripping jaws.

Example 14 includes the method of any one of examples 11-13, further including rotating a second pair of gripping jaws about a second common pivot in the directional drill vice to clamp on the second drill stem segment, while the first pair of gripping jaws are clamped onto the first drill stem segment, and driving relative rotation between the first pair of gripping jaws and the second pair of gripping jaws to break the drill stem coupling loose.

Example 15 includes the method of any one of examples 11-14, wherein driving relative rotation between the first pair of gripping jaws and the second pair of gripping jaws includes holding the second pair of gripping jaws fixed and rotating the first pair of gripping jaws.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A directional drill, comprising:

a drill head movably mounted to a carriage frame;

a directional drill vise mounted to the carriage frame, the directional drill vise, including:

a first gripper, including:

a first pair of gripping jaws located in the vise frame;

at least one first actuating device coupled to the first pair of gripping jaws;

a first common jaw pivot coupled to both jaws in the first pair of gripping jaws;

a second gripper, including:

a second pair of gripping jaws located in the vise frame;

at least one second actuating device coupled to the second pair of gripping jaws;

a second common jaw pivot coupled to both jaws in the second pair of gripping jaws;

a slot to permit sideways loading and unloading of drill rods into the first pair of gripping jaws, wherein the second pair of gripping jaws is completely laterally enclosed;

a rotation joint between the first gripper and the second gripper to provide rotation about a drill stem axis; and a rotation actuator to drive relative rotation between the first gripper and the second gripper.

2. The directional drill of claim 1, wherein the first common pivot is directly coupled in fixed relation to a structure of the directional drill vise different from the first pair of gripping jaws, wherein both jaws in the first pair of gripping jaws are constrained to only rotational motion relative to each other about the common jaw pivot.

3. The directional drill of claim 1, wherein the first pair of gripping jaws includes replaceable jaws held in jaw carriers.

4. The directional drill of claim 1, wherein each jaw in the first pair of gripping jaws is actuated by a separate actuating device.

5. The directional drill of claim 1, wherein the actuating devices include hydraulic actuating devices.

6. The directional drill of claim 1, wherein the rotation actuator is a hydraulic rotation actuator.

7. The directional drill of claim 1, wherein the first gripper is fixed with respect to the vise frame, and the second gripper rotates relative to the vise frame about the rotation joint.

8. A method of directional drilling, comprising:

moving a first drill stem segment from a drill rod magazine sideways into a first pair of gripping jaws of a directional drill vise;

actuating the first pair of gripping jaws to clamp the first drill stem segment;

screwing a drill head to the first drill stem segment;

releasing the first pair of gripping jaws;

threading the first drill stem segment onto a second drill stem segment to form a drill stem coupling, including actuating a second pair of completely laterally enclosed gripping jaws to clamp the second drill stem segment while threading the first drill stem segment onto the second drill stem segment.

9. The method of claim 8, wherein moving the first drill stem segment from the drill rod magazine sideways into the first pair of gripping jaws includes moving the first drill stem segment vertically from the drill rod magazine down into the first pair of gripping jaws.

10. The method of claim 8, wherein actuating the first pair of gripping jaws to clamp the first drill stem segment includes rotating the first pair of gripping jaws about a first common pivot, wherein the first common pivot is directly coupled in fixed relation to a structure of the directional drill vise different from the first pair of gripping jaws.

11. The method of claim 8, wherein actuating the first pair of gripping jaws to clamp the first drill stem segment includes using two actuators with one actuator for each jaw in the first pair of gripping jaws.

* * * * *